US012595795B2

(12) United States Patent
Hall et al.

(10) Patent No.: US 12,595,795 B2
(45) Date of Patent: Apr. 7, 2026

(54) CONTROLLING FRACTURING PUMPS IN A HYDRAULIC FRACTURING SYSTEM

(71) Applicant: ProFrac Holdings II, LLC, Willow Park, TX (US)

(72) Inventors: Christopher Floyd Hall, Perrin, TX (US); Kyle J. Keith, San Antonio, TX (US); Jonathan B. Vaughn, Helotes, TX (US); Michael Kurecka, Arlington, TX (US); Justin T. Robertshaw, Azle, TX (US); Jerry D. Stutsman, II, Lucky, LA (US)

(73) Assignee: ProFrac Holdings II, LLC, Willow Park, TX (US)

( * ) Notice: Subject to any disclaimer, the term of this patent is extended or adjusted under 35 U.S.C. 154(b) by 0 days.

(21) Appl. No.: 18/899,743

(22) Filed: Sep. 27, 2024

(65) Prior Publication Data

US 2025/0320860 A1 Oct. 16, 2025

Related U.S. Application Data

(60) Provisional application No. 63/633,243, filed on Apr. 12, 2024.

(51) Int. Cl.
*F04B 49/06* (2006.01)
*E21B 43/26* (2006.01)

(52) U.S. Cl.
CPC ..... *F04B 49/065* (2013.01); *E21B 43/2607* (2020.05); *E21B 2200/20* (2020.05)

(58) Field of Classification Search
CPC . F04B 49/065; E21B 43/2607; E21B 2200/20
See application file for complete search history.

(56) References Cited

U.S. PATENT DOCUMENTS

| | | | |
|---|---|---|---|
| 11,513,500 | B2 | 11/2022 | Jaaskelainen et al. |
| 11,702,920 | B1 | 7/2023 | Mao et al. |
| 2016/0258267 | A1 | 9/2016 | Payne et al. |
| 2019/0112910 | A1 | 4/2019 | Oehring et al. |
| 2020/0300050 | A1* | 9/2020 | Oehring ..... E21B 21/08 |
| 2021/0025267 | A1 | 1/2021 | Christie et al. |
| 2021/0396223 | A1 | 12/2021 | Yeung et al. |
| 2022/0090594 | A1 | 3/2022 | Reddy et al. |
| 2022/0112796 | A1 | 4/2022 | Jaaskelainen et al. |

(Continued)

*Primary Examiner* — Audrey B. Walter
(74) *Attorney, Agent, or Firm* — Henry Patent Law Firm PLLC

(57) ABSTRACT

In a general aspect, the present disclosure relates to techniques for providing a pumping control user interface used to control an automated hydraulic fracturing system. In some embodiments, a system displays a pumping control interface associated with a plurality of fracturing pumps. The system receives first input for a target input region. After receiving the first input, the system causes a hydraulic fracturing system to perform a hydraulic fracturing operation. While the hydraulic fracturing operation is being performed, the system displays an operation recommendation that includes displaying a suggested change to an operating setting. The system receives second input corresponding to acceptance of the operation recommendation and, in response, causes the hydraulic fracturing system to implement the operation recommendation and continue performing the hydraulic fracturing operation.

27 Claims, 11 Drawing Sheets

(56) References Cited

U.S. PATENT DOCUMENTS

| | | | | |
|---|---|---|---|---|
| 2022/0113702 | A1 | 4/2022 | Jaaskelainen et al. | |
| 2022/0268141 | A1 | 8/2022 | Krupa et al. | |
| 2022/0300148 | A1 | 9/2022 | Wang et al. | |
| 2023/0003115 | A1* | 1/2023 | Stark | E21B 43/2607 |
| 2023/0035493 | A1* | 2/2023 | LeBlanc | E21B 47/007 |
| 2023/0287777 | A1* | 9/2023 | Kabrich | F04B 49/007 |
| 2024/0003236 | A1 | 1/2024 | Kohli et al. | |
| 2024/0026764 | A1 | 1/2024 | Sun et al. | |
| 2024/0309741 | A1* | 9/2024 | Greska | E21B 43/2607 |

* cited by examiner

200

210

Alarms x | Treatment Summary x | Auto Pilot x

Run Status: Not Configured Operational Status: Blender(s) contribution does not equal 100% Contributors: None

| Step | | | | Target | | Clean | | Slurry | | Sand | | Time | |
|---|---|---|---|---|---|---|---|---|---|---|---|---|---|
| Step | Progress | Type | Description | Rate | Conc | Step | Actual | Step | Actual | Step | Actual | Step | Actual |
| 1 | 0.0% | Breakdown | | 10 | 0 | 10 | 0 | 10 | 0 | 0 | 0 | 00:01:00 | 00:00:00 |
| 2 | 0.0% | Acid Spearhead | | 20 | 0 | 15 | 0 | 15 | 0 | 0 | 0 | 00:00:45 | 00:00:00 |
| 3 | 0.0% | Pad | | 85 | 0 | 30 | 0 | 30 | 0 | 0 | 0 | 00:00:21 | 00:00:00 |
| 4 | 0.0% | Proppant | CS - 100 Mesh Native | 85 | 0.5 | 75 | 0 | 76 | 0 | 1575 | 0 | 00:00:54 | 00:00:00 |
| 5 | 0.0% | Proppant | CS - 100 Mesh Native | 85 | 1 | 75 | 0 | 78 | 0 | 3150 | 0 | 00:00:55 | 00:00:00 |
| 6 | 0.0% | Proppant | CS - 100 Mesh Native | 85 | 1.5 | 75 | 0 | 80 | 0 | 4725 | 0 | 00:00:56 | 00:00:00 |
| 7 | 0.0% | Proppant | CS - 100 Mesh Native | 85 | 2 | 75 | 0 | 81 | 0 | 6300 | 0 | 00:00:57 | 00:00:00 |
| 8 | 0.0% | Proppant | CS - 100 Mesh Native | 85 | 2 | 75 | 0 | 81 | 0 | 6300 | 0 | 00:00:57 | 00:00:00 |
| 9 | 0.0% | Proppant | CS - 100 Mesh Native | 85 | 1 | 75 | 0 | 78 | 0 | 3150 | 0 | 00:00:55 | 00:00:00 |
| 10 | 0.0% | Proppant | CS - 100 Mesh Native | 85 | 1.5 | 75 | 0 | 80 | 0 | 4725 | 0 | 00:00:56 | 00:00:00 |
| 11 | 0.0% | Proppant | CS - 100 Mesh Native | 85 | 2 | 75 | 0 | 81 | 0 | 6300 | 0 | 00:00:57 | 00:00:00 |
| 12 | 0.0% | Proppant | CS - 100 Mesh Native | 85 | 2.25 | 75 | 0 | 82 | 0 | 7087 | 0 | 00:00:58 | 00:00:00 |
| 13 | 0.0% | Proppant | CS - 100 Mesh Native | 85 | 2.5 | 75 | 0 | 83 | 0 | 7845 | 0 | 00:00:58 | 00:00:00 |
| 14 | 0.0% | Flush | | 85 | 0 | 0 | 0 | 0 | 0 | 0 | 0 | 00:00:00 | 00:00:00 |
| 15 | 0.0% | post.shutdown | | 1 | 0 | 0 | 0 | 0 | 0 | 0 | 0 | 00:00:00 | 00:00:00 |

Est Clean: 805 bbls Est Slurry: 855 bbls Est Sand: 51187 lbs Est Time: 00:00:00

FIG. 2

CONTROLLING FRACTURING PUMPS IN A HYDRAULIC FRACTURING SYSTEM

CROSS-REFERENCE TO RELATED APPLICATIONS

This application claims priority to U.S. Provisional App. No. 63/633,243, filed Apr. 12, 2024, entitled "Systems and Methods for Hydraulic Fracturing Pump Control," the entire content of which is hereby incorporated by reference.

BACKGROUND

The following description relates to controlling fracturing pumps in a hydraulic fracturing system. Fracture treatments have been used to stimulate the transfer of hydrocarbon resources from a subterranean formation to a wellbore. Fracture treatments typically introduce a pressurized fracturing fluid into the subterranean formation through a wellbore. The pressurized fracturing fluid can fracture the subterranean formation, and proppant material in the fracturing fluid can help stabilized the fractures.

DESCRIPTION OF DRAWINGS

FIG. 2 illustrates a pumping schedule user interface of an automated hydraulic fracturing system in accordance with some embodiments.

DETAILED DESCRIPTION

In some aspects of what is described here, systems and methods are disclosed for controlling pumping operations of a hydraulic fracturing system.

In a general aspect, operations of a hydraulic fracturing system are controlled by one or more computer systems. In some cases, the hydraulic fracturing system automates control of one or more operations of the hydraulic fracturing system. In some cases, the hydraulic fracturing system includes (or provides or interfaces with) an interface that provides control of and/or feedback regarding one or more operations of the hydraulic fracturing system. In some cases, the hydraulic fracturing system includes (or interfaces with) software, hardware, and/or one or more algorithms for controlling one or more operations of the hydraulic fracturing system. In some cases, the hydraulic fracturing system receives, via the interface, inputs (e.g., values) for controlling one or more aspects (e.g., parameters, settings, targets) of the operations of the hydraulic fracturing system. In some cases, the hydraulic fracturing system provides, via the interface, output of current operating conditions of equipment being used to perform one or more operations of the hydraulic fracturing system. In some cases, the hydraulic fracturing system provides, via the interface, output of operation recommendations for one or more operations of the hydraulic fracturing system. The operation recommendations can include, indicate, or involve changes to one or more operational aspects of the hydraulic fracturing system. In some cases, the operation recommendations can be accepted or declined via the interface. For example, if accepted, the hydraulic fracturing system can proceed to automatically implement various changes for carrying out the recommendation.

Using a hydraulic fracturing system as described herein can promote effective and precise stimulation of a well. For example, a hydraulic fracturing system can streamline operations and allow for a more efficient wellsite by utilizing real-time automation to control equipment, follow a pumping schedule with precision, and/or maximize fuel substitution. Using a hydraulic fracturing system as described in accordance with some embodiments described herein can enable an operator to increase the number of lateral feet completed per day, consistently meet completion design with precision, complete each stage of the operation safely, and/or integrate operations into a smaller footprint (e.g., pad). Additional and/or other benefits can be achieved in various implementations.

Figure 1:
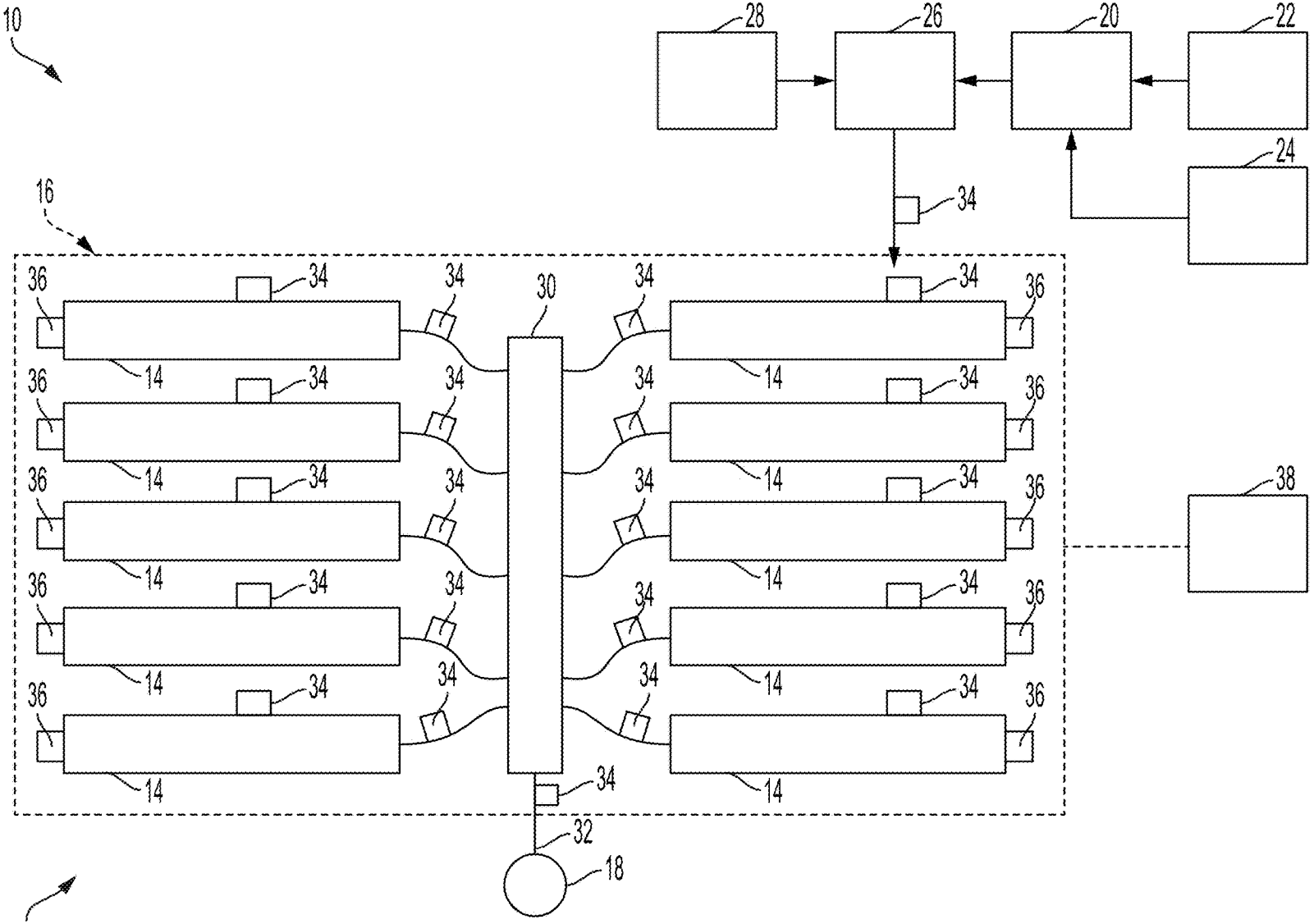
FIG. 1 illustrates a schematic plan view of an automated hydraulic fracturing system in accordance with some embodiments.

FIG. 1 is a schematic representation of an embodiment of a hydraulic fracturing system 10 positioned at a well site 12. In the illustrated embodiment, pump trucks 14, which make up a pumping system 16, are used to pressurize a fracturing fluid solution for injection into a wellhead 18. A hydration unit 20 receives fluid from a fluid source 22 via a line, such as a tubular, and also receives additives from an additive source 24 (e.g., a "chem add" source or unit). In an embodiment, the fluid is water and the additives are mixed together and transferred to a blender unit 26 where proppant from a proppant source 28 may be added to form the fracturing fluid solution (e.g., fracturing fluid or frac fluid) which is transferred to the pumping system 16. The pump trucks 14 may receive the fracturing fluid solution at a first pressure (e.g., 60 psi to 200 psi) and boost the pressure up to 15,000 psi for injection into the wellhead 18. In some embodiments, the pump trucks 14 are powered by electric motors.

After being discharged from the pump system 16, a distribution system 30, such as a missile, receives the fracturing fluid solution for injection into the wellhead 18. The distribution system 30 consolidates the fracturing fluid solution from each of the pump trucks 14 (for example, via common manifold for distribution of fluid to the pumps) and includes discharge piping 32 (which may be a series of discharge lines or a single discharge line) coupled to the wellhead 18. In this manner, pressurized solution for hydraulic fracturing may be injected into the wellhead 18. In the illustrated embodiment, one or more sensors 34, 36 are arranged throughout the hydraulic fracturing system 10. In embodiments, the sensors 34 transmit flow data to a data van 38 for collection and analysis, among other things.

Currently, the most common method of pump control is by using an operator to individually set pump rates to reach a desired total rate. This often relies on the skill of the operator and can be prone to errors due to accidental mouse clicks or an inattentive operator.

These problems can be addressed by automating hydraulic fracturing ("frac") pump operations, for example, to reduce the need for manpower, reduce operator error, improve response time to changing well conditions, increase equipment life, improve safety by optimizing rate and adhering to component limitations, and to increase post-stimulation well productivity. In some implementations, software and computer systems can be used to implement an automated hydraulic fracturing system. The software can act as a cruise control or pilot for frac pump rates by determining the best way to control individual equipment to supply a consistent slurry rate to a wellhead.

In some embodiments, the automated hydraulic fracturing system integrates data from one or more of the following equipment sources: blenders, frac pumps, data vans, switchgear trailers, generators, ESD trailers, fuel distribution trailers, and/or other sources.

In some embodiments, the automated hydraulic fracturing system provides the ability to turn off certain features based on customer interest, well operations, or equipment type. This can provide the ability to meet any customer expectations and to ease customers and technicians into automatic pump control.

In some embodiments, the automated hydraulic fracturing system imports data from one or more data sources (e.g., files, data storage repositories, devices, applications, etc.). For example, the automated hydraulic fracturing system imports well stimulation schedules (e.g., frac schedules) from a spreadsheet file and/or application (e.g., Microsoft Excel), this allows customer or in house engineers (e.g., that are either on or off site) to design their own frac schedules that can then be uploaded and run in the automated hydraulic fracturing system. Operators and engineers can also easily make on-the-fly changes to adjust the current stage schedule or the schedule for future stages. An example of a frac schedule is shown in FIG. 2, discussed below.

In some embodiments, the automated hydraulic fracturing system performs pumping rate control and/or pumping rate optimization. In some embodiments, the automated hydraulic fracturing system is configured to control pumping (e.g., the frac pumps, motors, transmissions, and/or other associated equipment) according to a frac schedule. In some embodiments, the automated hydraulic fracturing system follows a frac schedule that includes pumping at predetermined rates with total water volumes for each step before moving on to a subsequent step that can involve a rate change, chemical change, or proppant change. In some embodiments the software will calculate the best combination of individual pumps and pump rates to maintain a consistent total fluid rate at the wellhead. In some embodiments, compensations will be made if there is an individual pump failure or derate. In some embodiments, the automated hydraulic fracturing system also has the ability to put a pump into neutral (for diesel or dual fuel motors) or standby (for electric motors) if it experiences a sensor issue, high discharge pressure, or other equipment health problem.

In some embodiments, the automated hydraulic fracturing system performs pressure control and pressure optimization. This is similar to the rate control method, except the individual pump rates will be adjusted continuously to maintain a specific wellhead pressure regardless of the combined wellhead rate.

In some embodiments, automated control (e.g., of rate and/or pressure) includes comparing expected changes (e.g., to rate and/or pressure) to actual changes (e.g., outcome measured, for example, at an output of a pump and/or at the wellhead). In some embodiments, the automated hydraulic fracturing system adjusts efficiency factors (e.g., and or other data) based on the comparison of the expected changes to the actual changes (e.g., based on a result of the comparison and/or a value derived from the result). For example, adjusting efficiency factors can provide the automated hydraulic fracturing system with more accurate data (e.g., input) so that subsequent recommendations can be more accurate. There is typically variance between the expected change and the actual outcome due to pump wear and/other real-world effects.

For example, an efficiency factor (e.g., a percentage representing an efficiency of a respective pump) is usually a number between 0.90 and 0.99 and is used to compensate for the wear on the pump components when the real fluid output rate doesn't match the calculated rate based on the pump RPM. In some existing systems, the efficiency factor is a static number that is typed in by the pump control operator and is not adjusted properly as wear and tear accumulates (or is repaired) on the equipment over multiple frac stages. This static number usually results in the total measured fluid rate being slightly lower than the total calculated rate causing the operator to make suboptimal or incorrect changes and/or assumptions, such as to increase flow rate to compensate, adjust efficiency numbers blindly, suspect a fluid leak, suspect an unprimed pump or flow tube, and/or doubt the blender flowmeters. An operator might not understand or accept this mismatch in data.

In some embodiments, the automated hydraulic fracturing system provides algorithm-based operator recommendations. In some embodiments, a recommendation is based on the output of one or more machine learning models and/or artificial intelligence algorithms. In some embodiments, these are given on a tiered progression (e.g., sequentially in time) and the operator can either approve or deny the suggestion. In some embodiments, the recommendations are dynamic and will change if either the operator denies them, or if there is a changing condition. In some embodiments, if a maintenance issue is detected with an individual frac pump, the program will provide recommendations on reducing rate or shutting down that particular pump and simultaneously increasing rate in other pumps to maintain the same combined wellhead rate.

In some embodiments, the automated hydraulic fracturing system allows an operator to define the step (rate change in barrels per minute of slurry) size and how many steps they want during ramp up or ramp down. For example, this allows a quick shutdown or slow shutdown based on customer expectations, engineering requirements (water hammer), or equipment life requirements (e.g., preventing loss of turbines for E-fleets).

For example, the step size for ramp up and/or ramp down can be critical for electric pumps. Aggressive step sizes (e.g., very quick changes) can cause excessive power surges that trip off the electric power supply. A single, or even multi-turbine, power generation solution for a fleet of electric pumps (also referred to as an "E-fleet") is not as dynamic as 16-20 individual diesel engines for a diesel (or dual fuel) frac fleet. For example, if a wellsite needs to quickly reduce or increase rate by 40 barrels per minute, that may just be a few 100 hp per diesel engine for a diesel frac fleet. For an electric frac fleet, for example, the turbine (part of and/or coupled to a generator supplying power to the electric pumps) may have to pick up or shed several thousand horsepower within a few seconds while trying to maintain a constant generator RPM. If the turbine attempts to ramp up or ramp down too quickly and can't maintain a consistent RPM, an under or over voltage situation will occur and will cause the protection circuits to trip, resulting in loss of power (e.g., blacking out) the frac site. This can result in total loss of fluid rate at the wellhead and a screen out of the well which can be a multi-million dollar mistake with several days of downtime to clear. Having the software manage the limitations of ramp up and ramp down based on the power generation equipment on site can prevent this, whereas as a human operator may adjust pump rates too slowly to prevent a black out (which can affect well stimulation or be inefficient) or adjust them too quickly causing an electrical black out.

In some embodiments, one or more electric motors (e.g., driving one or more pumps) is controlled by one or more variable frequency drives (VFDs). For example, a VFD can be used as a motor controller for an electric motor, for controlling the speed and/or torque of the electric motor by varying the frequency and/or voltage of electricity supplied to the electric motor. For example, each electric motor can be controlled by a VFD, and each electric motor can be coupled to drive a pump.

In some embodiments, the automated hydraulic fracturing system can be used with electric, dual fuel, and/or diesel equipment, as well as hybrid options where equipment type will be mixed and matched to meet customer demands, hydraulic horsepower (HHP) demands, or efficiency requirements. For example, the automated hydraulic fracturing system can be used to automate pumping of an all-electric fleet of pumps powered by electric motors.

In some embodiments, the automated hydraulic fracturing system allows for reduction of onsite personnel. With the automated hydraulic fracturing system able to direct the rate control of frac pumps and handle unexpected equipment issues, the position of pump control can potentially be merged together with the position of the service supervisor/treater.

In some embodiments, the automated hydraulic fracturing system performs frac schedule optimization. In some embodiments, the automated hydraulic fracturing system uses complex algorithms and/or AI technology to pull customer and industry data about past well stimulation techniques and frac schedules and compare it to long term well production results to develop an improved frac schedule to tailor production and revenue with the cost of chemicals, proppants, water volume, and HHP on site. This can also be used to determine the optimal frac rate and water volume per stage to reduce the time for each frac stage so more stages can be performed per day.

In some embodiments, the automated hydraulic fracturing system performs operator-less pump control. As trust is built in the system and the algorithms mature, the step of having an onsite operator to approve or deny the software suggestions may be removed.

In some embodiments, the automated hydraulic fracturing system supports Dual Frac, Simul-frac, and split stream operations support.

In some embodiments, the automated hydraulic fracturing system performs equipment health monitoring, such as iron harmonics and vibration monitoring. This equipment health monitoring can help shift maintenance programs from being reactive, to being predictive instead. In some embodiments, vibration and/or harmonic data can be used by the software to suggest changes in individual pump rates to reduce damaging vibrations without affecting the total combined pump rate seen by the wellhead. For example, in a four pump system, if pump number 4 is seeing excessive vibrations, the software may suggest reducing its rate by 3 barrels per minute while simultaneously increasing rate on pumps number 1, 2, and 3 by 1 barrel per minute each to compensate.

In some embodiments, the automated hydraulic fracturing system performs automatic work order creation for pumps that experienced problems during a frac stage and for equipment that is experiencing a degradation of health as seen in metrics such as pressures, temperatures, viscosities, vibrations, or component hours.

In some embodiments, the automated hydraulic fracturing system performs fuel optimization. The pump rate suggestions from the software can be used to optimize fuel blending in dual fuel pumps (e.g., pumps powered by motors that are capable of operating using multiple fuels such as diesel and natural gas) by holding individual pumps in their highest substitution range as often as possible. This can also be achieved with hybrid fleets where dual fuel horsepower will be ran only at their best substitution range while electric equipment will be used to supplement horsepower and act as a "peaker" for rate increments that would normally force dual fuel pumps to operate outside of their optimal substitution range.

In some embodiments, the automated hydraulic fracturing system performs electricity optimization. Similar in concept the fuel optimization, an all-electric fleet usually has a limitation on how much power is available from a turbine at any given time based on ambient conditions such as temperature, humidity, and varying fuel pressures. Altitude, the state of turbine maintenance, and fuel quality can also affect the turbine output. This software can be used to either predict the maximum turbine power generation based on historical and OEM data, or it can be supplied live data directly from the power generation equipment and operate the frac pumps to make sure this value is not exceeded to prevent an unexpected shutdown. This same logic can be used for load shedding where a turbine maintenance issue can be detected and pumps automatically shutdown to prevent a total site blackout. A generator failure on a multi-generator frac site can also be accounted for by load shedding equipment or making sure the new available power from the remaining generators is never exceeded even if the uploaded frac schedule demands a higher horsepower than can be achieved. If multiple power sources exist, such as a large gas turbine load sharing with a utility power connection, the cheapest source can be used such as automatically using utility power at night or on weekends when the kilowatt-hour (kWh) cost is lower and using the gas turbine when power costs increase during peak grid demand. If a customer has pipeline volume limitations, the same logic can be applied to using as much lower-cost pipeline gas as possible before switching over to compressed natural gas (CNG) or liquefied natural gas (LNG) based fuel sources.

FIG. 2 illustrates a pumping schedule user interface 200 of an automated hydraulic fracturing system in accordance with some embodiments. In some embodiments, a pumping schedule user interface 200 illustrates a pumping schedule (also referred to as a frac schedule). For example, the pumping schedule can be an input to an automated hydraulic fracturing system, which follows the schedule to automatically carry out control of some or all aspects of hydraulic fracturing operations. In some embodiments, the automated hydraulic fracturing system determines one or more operational recommendations that differ from the pumping schedule and/or for achieving a target rate of the pumping schedule.

The pumping schedule user interface 200 of FIG. 2 includes a number of steps 210 (numbered 1 through 15) of an example pumping schedule (frac schedule). In some embodiments, a pumping schedule includes any number of steps 210. The pumping schedule user interface 200 of FIG. 2 includes a progress indicator for each step. The pumping schedule user interface 200 of FIG. 2 also includes an indication of a type of each step and a description of each step. The pumping schedule user interface of FIG. 2 includes additional information, including a target rate of each step (e.g., in barrels per minute, of fluid for pumping into a well), fluid content information (e.g., chemical, slurry, and/or sand), and a time period of each step. In some embodiments, the time period of a step is governed by the designed barrels of fluid to be pumped for the step. For example, the time period is calculated based on the target rate and the planned barrels of fluid to be pumped (e.g., a step that includes pumping a total of 10,000 barrels at a rate of 100 barrels per minute results in a time period of 100 minutes).

In some embodiments, a pumping schedule is used for automated control of less than all of the equipment of a hydraulic fracturing system. For example, pumping schedule 200 can be used to automatically control one or more blenders (blender units), such that the blenders automatically operate to create frac fluid for each step having a composition according to the pumping schedule. The blenders can create the frac fluid according to the volume of fluid or the length of time specified for a given step of the schedule and then automatically adjust the composition when the time for the current step elapses according to the schedule. In some embodiments, automated hydraulic fracturing system provides automated operation recommendations for changing frac pump settings at the beginning (or end) of each step based on pumping schedule 200. In such examples, while the blender operation is configured to run through the pumping schedule 200 in a fully automated manner, changes to frac pumping settings need to be reviewed and/or accepted by an operator. The recommendations at each step transition can be configured to achieve the targets associated with the next or current step. That is, the automated hydraulic fracturing system can populate targets (e.g., treatment pressure or pumping rate in region 340 of FIG. 3) for the pumping operations using the schedule and provide recommendations (e.g., in region 330 of FIG. 3) based on actual current operation conditions that, when accepted, carry out the pumping control changes (e.g., adjust throttle, adjust motor RPM, change transmission gear).

Figure 3:
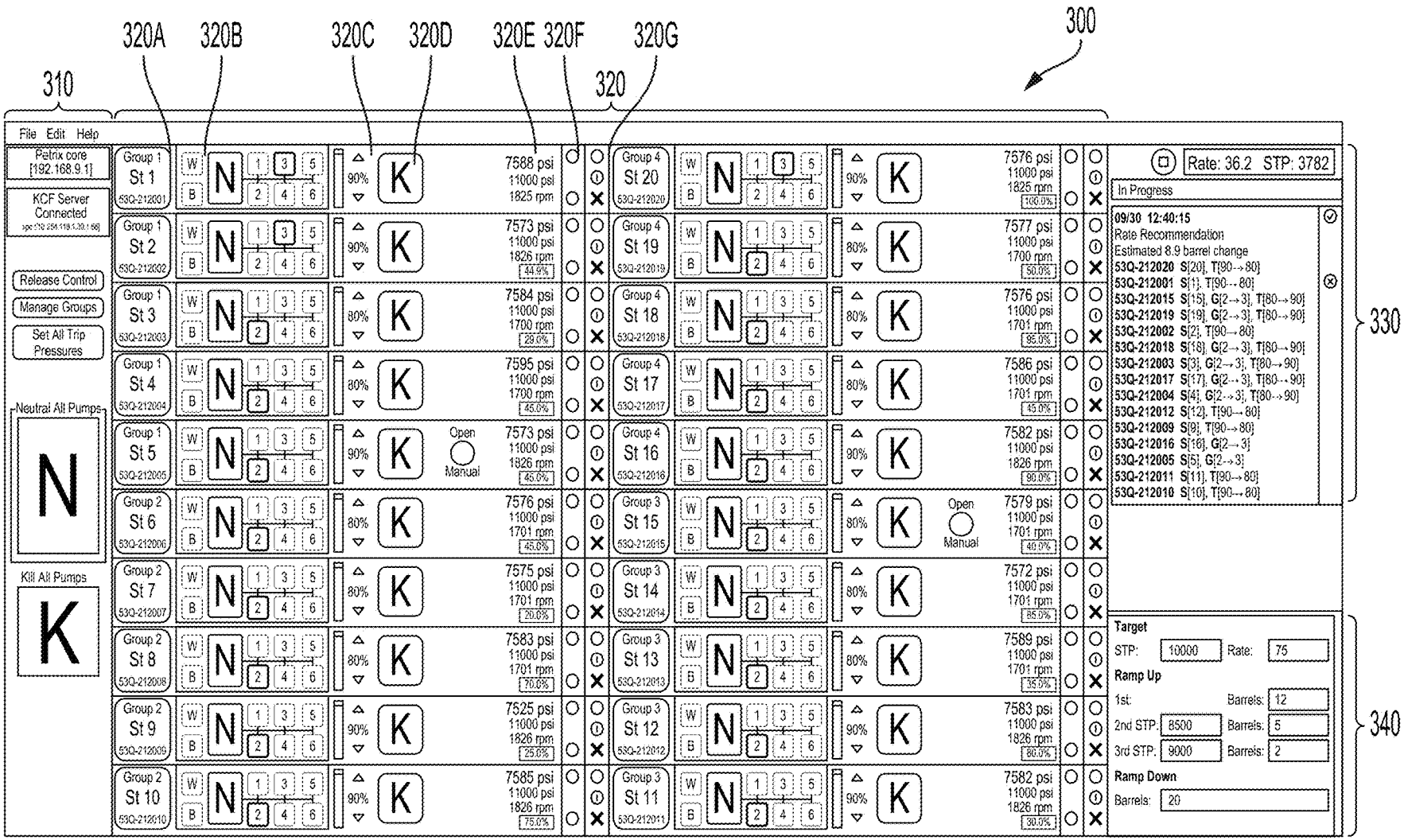
FIG. 3 illustrates a pumping control user interface of an automated hydraulic fracturing system in accordance with some embodiments.

FIG. 3 illustrates a pumping control user interface 300 of an automated hydraulic fracturing system in accordance with some embodiments. Pumping control interface 300 includes a system region 310, a pump information region 320, an operation recommendation region 330, and a target input region 340. System region 310 includes information and/or controls pertaining to a software application providing interface 300 and/or related to all connected pumps of the automated hydraulic fracturing system. For example, system region 310 includes controls for placing all pumps in neutral or for killing all pumps (stopping and/or powering off).

Pump information region 320 of pumping control user interface 300 includes multiple regions (subregions) that each include information for an individual pump. Within each region of pump information region 320, information corresponding to the respective pump includes identification information 320A, which includes information for identifying a pump or a group of pumps, such as group information (e.g., identifying the group that the pump is configured to be part of), location information of the pump (e.g., "St 1" for station 1, "St 2 for station 2, etc.), and a unique identifier for the pump (e.g., 53Q-212001, 53Q-212002, etc.).

Pump information region 320 also includes a gear indicator 320B that indicates a transmission gearing and/or current transmission gear. Pump information region 320 also includes a throttle level control 320C that can be used to control (e.g., via selection of the up or down arrows) the throttle for the motor that is coupled to and driving the respective pump, and that includes an indication of the current throttle level (e.g., in percentage). Pump information region 320 also includes a stop control 320D (e.g., for stopping, or "killing," the corresponding pump).

Pump information region 320 also includes indicator 320E that includes indications of a current pressure reading corresponding to the pump (e.g., 7588 psi for pump 53Q-212001), a maximum pressure rating of the pump (e.g., 11000 psi), a current speed reading corresponding to a motor of (e.g., coupled to) the pump (e.g., in rotations per minute) (e.g., 1825 RPM). Pump information region 320 also includes indicator 320F indicating an eligibility (e.g., availability) status of the pump (e.g., green light means available, red light means unavailable, and yellow light means limited availability or existence of an issue).

Pump information region 320 also includes control section 320G, which includes controls and an indicator corresponding to operation of the respective pump. In FIG. 3, control section 320G includes three vertically-arranged shapes. The top shape is an O-shaped alarm indicator that indicates when an alarm condition occurs for the corresponding pump (e.g., sensor readings indicate the pump is not operating correctly). The middle shape is an O-shaped control (that includes an "i" in the middle) that, when selected, causes the system to display information (e.g., additional details) regarding the corresponding pump. The bottom shape is an X-shaped control that, when selected, causes the system to "unmap" (e.g., remove, delete, or set as unavailable) the corresponding pump from being used in the pumping operations controlled by the automated hydraulic fracturing system. In this example, indicator and controls of control section 320G correspond to pump 53Q-212020.

In some implementations, pump control user interface 300 includes one or more controls for accepting or declining recommendations corresponding to individual respective pumps (or pump groups). For example, an operator can decide that they do not want that particular change a specific pump to occur and can select a control to decline that portion of the recommendation. In some embodiments, the automated hydraulic fracturing system determines a new operation recommendation in response to determining that one or more recommendations for individual pumps have been declined or accepted. For example, the automated hydraulic fracturing system can redetermine changes to the remaining pumps to compensate for the declined individual pump recommendation(s).

In some embodiments, a pump is powered by a motor. In some embodiments, the motor is a diesel motor. In some embodiments, the motor is a dual fuel motor. In some embodiments, the motor is an electric motor. In some embodiments, the pumping control user interface does not include gearing and/or throttle information for a pump powered by an electric motor. For example, an electric motor may not be coupled to a transmission (gearing) or a throttle. Thus, for example, instead of gearing and/or throttle information, pump control user interface can include an indication of whether the electric motor is energized or de-energized (e.g., not energized).

In some embodiments, output of the automated hydraulic fracturing system depends on a characteristic of the pump and/or motor. In some embodiments, the output includes a gear setting (e.g., for a transmission). In some embodiments, the output includes a throttle setting. For example, for a pump driven by a diesel motor coupled to a transmission, the automated hydraulic fracturing system can output a control instruction (e.g., command, signal, and/or message) that includes a gear setting and/or a throttle setting (e.g., that the motor, transmission, and/or associated controller(s) should apply). In some embodiments, the output includes a rotational speed setting (e.g., in revolutions per minute (RPM)). For example, output by the automated hydraulic fracturing system to control an electric motor that is not coupled to a transmission does not require a gear setting, and the output setting can instead include a target rotational speed setting (e.g., in RPMs) for the electric motor (e.g., target speed at which to spin the pump). For example, electric motors used in a frac operation can be capable of spinning up to 1000 RPM, but an operator can desire to prevent operation of the motor to exceed 850 RPM. In some embodiments, an automated hydraulic fracturing system knows the linear scale of RPM per BPM (barrels per minute) and will use knowledge to request the proper target RPM of a variable frequency drive (VFD) driving the electric motor.

The pumping control user interface 300 of FIG. 3 includes an operation recommendation region 330 (e.g., in the top-right corner as shown in FIG. 3). The content of an example operation recommendation region is described in more detail in the description of FIG. 5.

The pumping control user interface 300 of FIG. 3 includes a target input region 340 (e.g., in the bottom-right corner as shown in FIG. 3). The target input region 340 is described in more detail in the description of FIG. 4.

Figure 4:
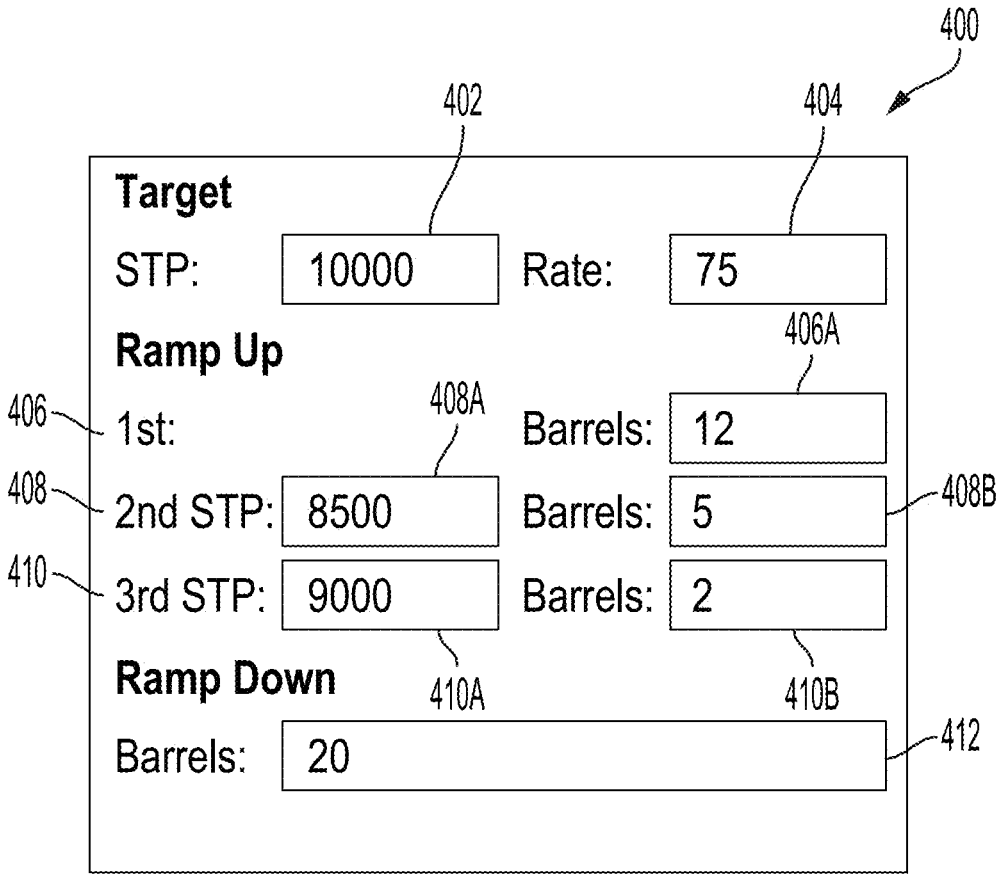
FIG. 4 illustrates a pumping control user interface of an automated hydraulic fracturing system in accordance with some embodiments.

FIG. 4 illustrates a target input region 400 of a pumping control user interface (e.g., 300 of FIG. 3). The target input region 400 includes input field 402 for accepting input of a target maximum total pumping pressure (e.g., combined pumping pressure at a wellhead due to operation of the multiple pumps in the hydraulic fracturing system), which is labeled "STP" (which stands for "surface treating pressure") under the heading "Target". The target input region 400 includes input field 404 for accepting input of a target pumping rate, which is labeled "Rate" (e.g., a pumping rate in barrels per minute of fluid) under the heading "Target". In this example, the automated hydraulic fracturing system will try to achieve a surface treating pressure of 10,000 psi while pumping at 75 barrels per minute.

The target input region 400 includes an area labeled by the heading "Ramp Up" that includes regions for accepting input of a target STP and pumping rate for each of three separate ramp-up periods (1st, 2nd, and 3rd periods). The ramp-up periods can be used by the automated hydraulic fracturing system to gradually increase pumping pressure and pumping rate at the wellhead to the target values in fields 402 and 404. For example, a first ramp-up period is defined by input field 406, which includes field 406A for receiving input of a target pumping rate for the first ramp-up period. In this example, at the beginning of the current treatment step (e.g., a step of a frac schedule such as 200 of FIG. 2), the automated hydraulic fracturing system will ramp up (increase) the pumping rate in steps of 12 barrels per minute until reaching an STP delimiting the end of the first ramp-up period (or beginning of the second ramp-up period). In the example shown in FIG. 4, during the first ramp-up period the automated hydraulic fracturing system will increase the pumping rate in steps of 12 barrels per minute until the 2nd period target STP of 8500 psi is reached. In some embodiments, the automated hydraulic fracturing system increases the pumping rate by the rate change (e.g., increases by 12 bbls/min) and then pauses for some amount of time before continuing increasing the rate by another rate change (e.g., another 12 barrels per minute). The automated hydraulic fracturing system can pause to perform one or more checks or determinations that there are no detected issues (e.g., pump derates, failures, or other equipment health issues) before proceeding.

As shown in FIG. 4, a second ramp-up period is defined by region 408, which includes field 408A for receiving input of an STP for the (beginning of the) second ramp-up period and field 408B for receiving input of a target pumping rate for the second ramp-up period. In this example, the 2nd ramp-up period STP in input field 408A is set to 8500 pounds per square inch (psi) and indicates that the 2nd period begins when the total pumping pressure (e.g., at the wellhead) reaches 8500 psi. In this example, during the second period, the automated hydraulic fracturing system will increase the pumping rate in steps of 5 barrels per minute until the 3rd period target STP of 9000 psi is reached.

As shown in FIG. 4, a third ramp-up period is defined by region 410, which includes input field 410A for receiving input of an STP for the (beginning of the) third ramp-up period and input field 410B for receiving input of a target pumping rate for the third ramp-up period. In this example, the 3rd period begins when the total pumping pressure reaches 9000 psi. In this example, during the 3rd period the automated hydraulic fracturing system will increase the pumping rate in steps of 2 barrels per minute until the total target STP of 10,000 psi (as defined in input field 402) is reached or until target rate reaches 75 barrels per minute (as defined in input field 404), whichever comes first.

The target input region 400 includes an area labeled by the heading "Ramp Down" that includes input field 412 for accepting input of a ramp-down step size for pumping rate in barrels per minute. For example, when a frac schedule step (or entire stage) ends or pumping is stopped for some reason, the automated hydraulic fracturing system can reduce the pumping rate in a controlled manner according to the specified ramp-down step size in input field 412. In this example, the step size is 20 barrels per minute and the automated hydraulic fracturing system will reduce the pumping rate by that much when targeting an STP lower than the current treatment pressure. For instance, if STP in input field 402 is set to 1 psi, the automated hydraulic fracturing system will ramp-down the pumping rate by 20 barrels per minute until the pressure target is met. As noted above, a gradual ramp down can be crucial for electric pumping fleets, so as not to trigger a power blackout. While the example illustrated in FIG. 4 includes three ramp-up periods and one ramp-down period, any number of ramp-up or ramp-down periods can be specified via a target input region as described herein (e.g., having fields or controls for specifying an arbitrary number of such periods).

Figure 5:
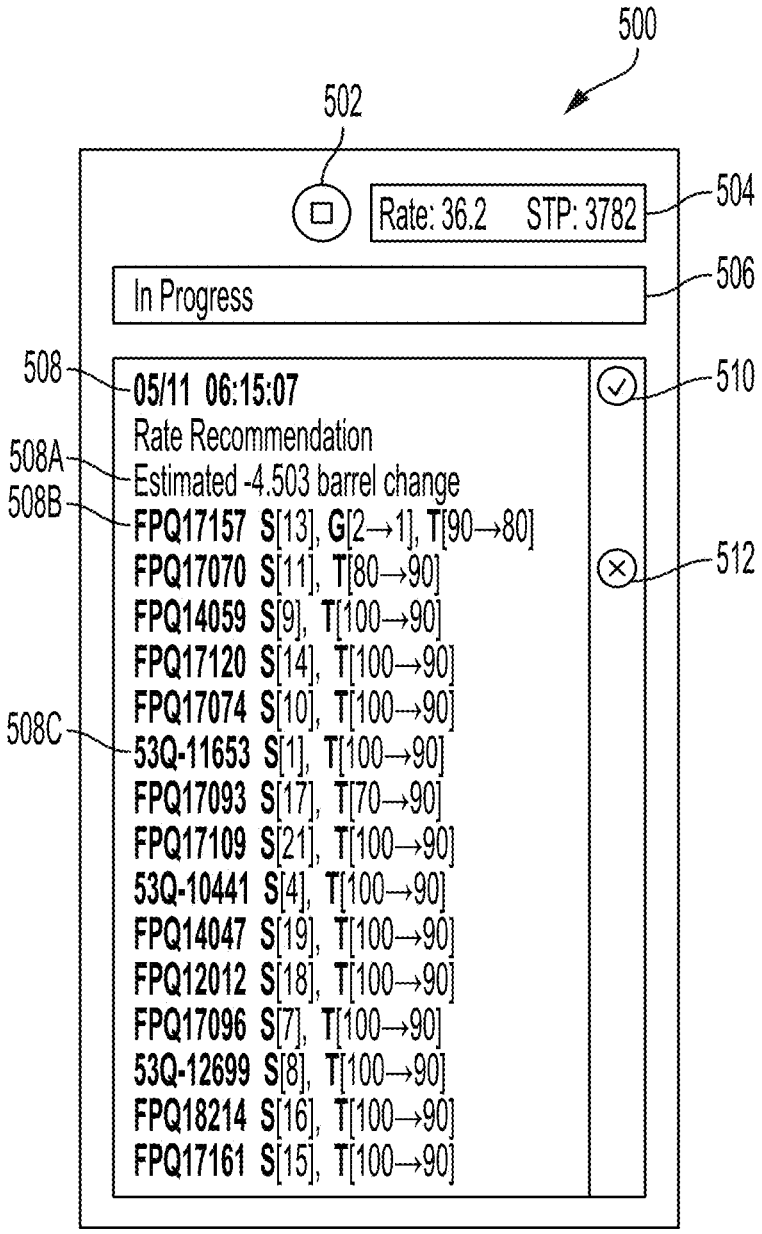
FIG. 5 illustrates a pumping control user interface of an automated hydraulic fracturing system in accordance with some embodiments.

FIG. 5 illustrates an operation recommendation region 500 of a pumping control user interface (e.g., 300 of FIG. 3). Operation recommendation region 500 includes a control 502 that, when selected, causes automated hydraulic fracturing system to cease providing operation recommendations (e.g., pauses automated recommendations from being made). Operation recommendation region 500 includes pumping information region 504, which includes a current pumping rate (e.g., 36.2 barrels per minute) and a current surface treating pressure (e.g., 3782 psi). In some embodiments, pumping information region 504 includes additional or different (e.g., less) pumping-related information than what is depicted in FIG. 5. Operation recommendation region 500 includes a recommendation status indicator 506 that provides a status of the recommendation in recommendation region 500.

The operation recommendation region 500 includes an operation recommendation 508. In some embodiments, an operation recommendation 508 includes information that identifies a rate recommendation change 508A (e.g., modification to the target rate in field 404 of FIG. 4 and/or a change is expected to occur to an actual pumping rate). In the example illustrated in FIG. 5, the rate recommendation change 508A indicates the recommendation is (or will result in) a "−4.503 barrel change" (representing a reduction in a pumping rate of 4.503 barrels per minute of fluid). The operation recommendation region 500 also includes pump recommendation information (e.g., 508B and 508C) for each pump that includes how operation of each pump will be changed in order to cause the recommended rate change. For example, for pump FPQ17157, information 508B indicates: station number (e.g., "S[13]" is station 13), a gear change (e.g., "2→1" is a change from second gear to first gear of a transmission of the pump), and a throttle change (e.g., "T[90→80]" indicates throttle change from 90% throttle to 80% throttle). As another example, for pump 53Q-11653, information 508C indicates: station number (e.g., "S[1]" is station 1), no gear change for a transmission coupled to the pump's motor, and a throttle change (e.g., "T[100→90]" indicates throttle change from 100% throttle to 90% throttle). In some embodiments, if a pump is powered by an electric motor, a gear and/or throttle change is not displayed (e.g., due to the electric motor not including a transmission or throttle). In some embodiments, the operation recommendation includes a change to the pumping rate (e.g., in barrels per minute) attributable to the corresponding pump. For example, for an electric pump (or other type such as diesel or dual fuel), the corresponding pump recommendation information (e.g., 508B, 508C) includes an indication of the change in the pumping rate of the corresponding pump, such as "Barrels [3 bbl/min→2.5 bbl/min]"). In some embodiments, if a pump is powered by an electric motor, the operation recommendation includes a change to a rotational speed of the motor (e.g., in RPMs, such as "RPM [3000→2500]").

As illustrated in FIG. 5, operation recommendation region 500 also includes a control 510 for accepting the recommendations of the automated hydraulic fracturing system (e.g., box with a checkmark). The operation recommendation region 500 also includes a control 512 for declining the recommendations of the automated hydraulic fracturing system (e.g., box with an "X" symbol).

In some embodiments, operation recommendation region 500 includes a status indicator that provides a status for the automated hydraulic fracturing system (e.g., "started" meaning it is enabled and will make operation recommendations or "disabled" meaning it is disabled and will not make operation recommendations).

In some embodiments, automated hydraulic fracturing system automatically performs one or more operations (e.g., such as those shown in operation recommendation region 330 of FIG. 3 and/or 500 of FIG. 5). For example, some operations may automatically be performed without input selecting control 510 for accepting the recommendations. In some embodiments, this high-trust scenario can be enabled or disabled by a user (e.g., via one or more controls at a pumping control interface).

An automated hydraulic fracturing system can utilize artificial intelligence (AI) and/or machine learning (ML) during operation and/or to improve future operation. In some embodiments, the recommendations output by the automated hydraulic fracturing system are generated by one or more AI and/or ML models. For example, input (e.g., parameters, conditions, settings, preferences, and/or other information) can be provided for processing by one or more AI and/or ML models (e.g., algorithms, models, and/or programs). The output of the one or more AI and/or ML models can be (and/or be used to generate) a recommendation for the pumping operations such as a recommended rate change. In some embodiments, the one or more AI and/or ML models are included in the automated hydraulic fracturing system and/or accessed by (e.g., external to and accessed via a network connection) the automated hydraulic fracturing system. In some embodiments, input from the automated hydraulic fracturing system is used for training the one or more AI and/or ML models (e.g., training and/or re-training based on historical data for improving the model).

In some embodiments, the automated hydraulic fracturing system utilizes one or more AI and/or ML models to predict pressure spikes and adjust rate accordingly. In some embodiments, the automated hydraulic fracturing system utilizes one or more AI and/or ML models to detect potential equipment issues and/or failures and shift load to healthy pumps before pumping rate is lost. In some embodiments, the automated hydraulic fracturing system utilizes one or more AI and/or ML models to hedge against (e.g., prevent and take remediation activity in response to) screen out and/or sand off conditions. In some embodiments, the automated hydraulic fracturing system utilizes one or more AI and/or ML models to optimize fuel/energy consumption (dual fuel, diesel, electric). In some embodiments, the automated hydraulic fracturing system utilizes one or more AI and/or ML models to optimize the pump schedule to achieve maximum reservoir output.

Figure 6:
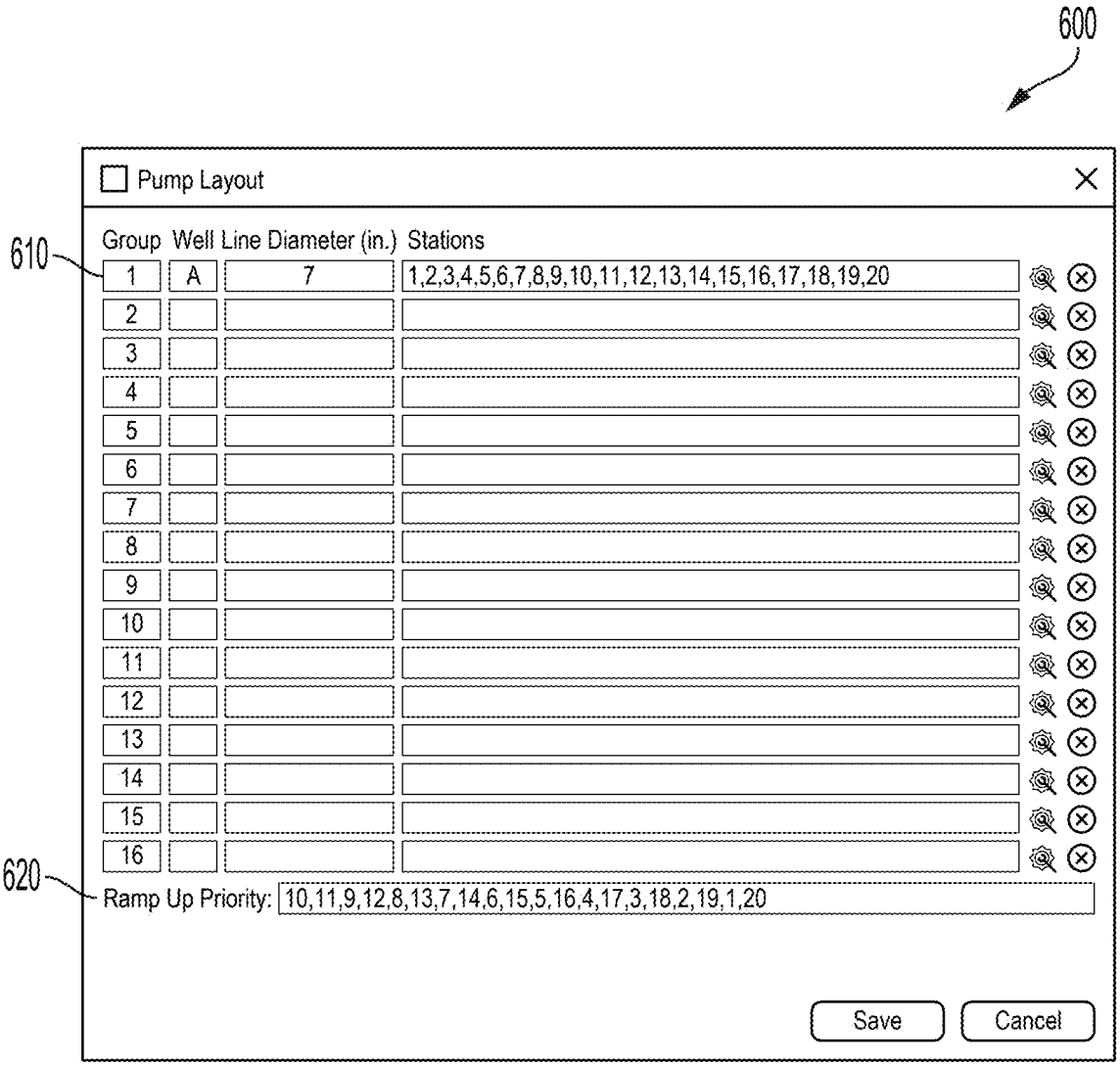
FIG. 6 illustrates a pumping control user interface of an automated hydraulic fracturing system in accordance with some embodiments.

FIG. 6 illustrates a pumping control user interface of an automated hydraulic fracturing system in accordance with some embodiments. In particular, FIG. 6 illustrates a pump layout user interface 600. The pump layout user interface 600 includes rows 610 for each group of one or more pumps. In this example, the groups of pumps specified in pump layout user interface 600 are the same as the groups indicated in pump control interface 300 of FIG. 3. For example, the group specified in interface 600 can refer to a group of all of the pumps at the wellsite. In the example illustrated, the automated hydraulic fracturing system includes one group of pumps in row 610 that correspond to wellsite "A" having a line diameter of 7 inches. The group in row 610 includes twenty (20) stations (e.g., pumps). The pump layout user interface 600 also includes an indication 620 of the ramp up priority order of the stations. In this example, the order is the following: 10, 11, 9, 12, 8, 13, 7, 14, 6, 15, 5, 16, 4, 17, 3, 18, 2, 19, 1, 20. For example, when ramping up pumping according to ramp-up periods defined in target input region 340 of FIG. 3 or 400 of FIG. 4, the automated hydraulic fracturing system can increase pumping rates at each frac pump in sequential order according to the ramp up priority order of indication 620. In some embodiments, the ramp up order can be changed via user input received at pump layout user interface 600 (e.g., text entry into the corresponding field). In some embodiments, the automated hydraulic fracturing system includes (e.g., controls) any number of groups (of one or more pumps).

In some embodiments, in a layout with multiple lines, the pump layout user interface allows the user to specify line diameters for each line (e.g., which be same or different). For example, a line diameter other than 7 inches can be specified (e.g., 4 inches or any other value). In some embodiments, the automated hydraulic fracturing system uses the line diameters to prevent over-rating the iron (of the respective line). For example, the fluid rate limit on a 3-inch iron line can be 18 barrels per minute. The system can be aware of line diameter rate limitations and can prevent a line from being over-rated.

Figure 7:
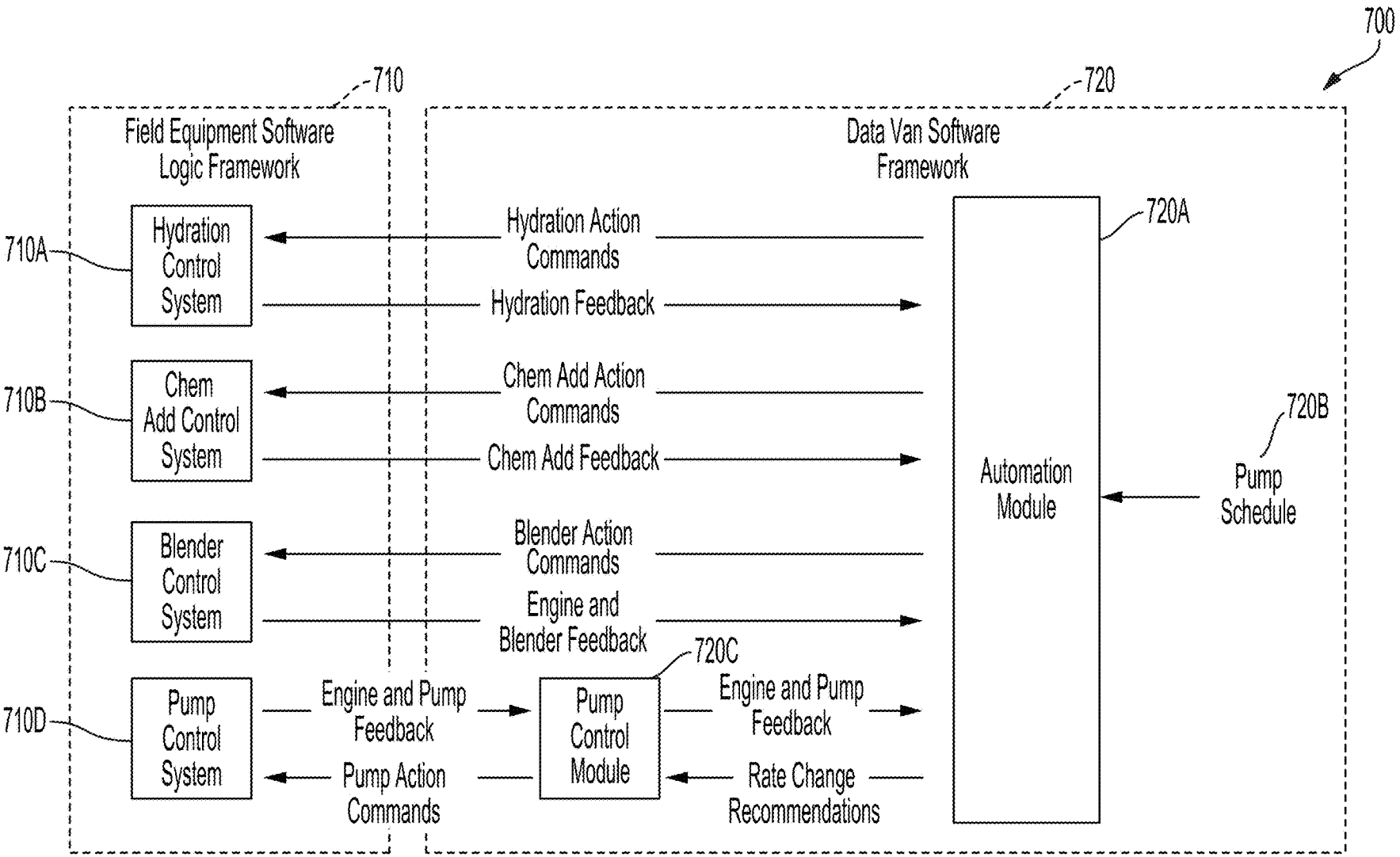
FIG. 7 illustrates a block diagram showing an architecture for control of a hydraulic fracturing operation in accordance with some embodiments.

FIG. 7 illustrates a block diagram showing an architecture for control of a hydraulic fracturing operation in accordance with some embodiments. Diagram 700 is divided into two logical groups of functions: those grouped in block 710 representing functions or features performed by field equipment software (e.g., on site where the hydraulic fracturing is occurring) and those grouped in block 720 representing functions or features performed by data van software (e.g., on or off site where the hydraulic fracturing is occurring). Note that the grouping within or by blocks 710 and 720 are merely illustrative of a particular example and the features defined therein can be performed by the same or different grouping or architecture.

In block 710, a hydration control system 710A is used to control one or more hydration units, a chemical additive ("chem add") control system 710B is used to control one or more chemical additive units, and a blender control system 710C is used to control one or more blender units. The hydration control system 710A, chem add control system 710B, and blender control system 710C can work together (e.g., be controlled in synchronization by, for example, an automated hydraulic fracturing system) to create a frac fluid for a pumping step that has a desired composition (e.g., as specified in a frac schedule). For example, as illustrated in FIG. 7, hydration control system 710A, chem add control system 710B, and blender control system 710C can each receive commands from and/or provide feedback to automation module 720A (of block 720).

In block 710, pump control system 710D represents components and/or logic for actually implementing changes to the operation of each pump being controlled by the automated hydraulic fracturing system. For example, pump control system 710D can represent motor control electronics (e.g., VFDs) that apply control signals for controlling the motors coupled to the pumps. As shown in FIG. 7, pump control system 710D receives pump action commands from and/or provides engine (or motor) and pump feedback to pump control module 720C (of block 720).

In block 720, automation module 720A is configured to receive a pump schedule 720B. For example, pump schedule 720B can be received as a file (e.g., uploaded) or entered at a user interface (e.g., 200 of FIG. 2) provided by an application (e.g., that includes automation module 720A). For example, a software application or program that includes (or is) automation module 720A can provide a user interface for inputting or loading pump schedule 720B. Pump schedule 720B and the feedback received from the various other modules of FIG. 7 can be used by automation module 720A to determine one or more operations of an automated hydraulic fracturing system. Block 720 also includes pump control module 720C, which represents a module that processes rate change recommendations from the automation module 720A into pump action commands for pump control system 710D. In some embodiments, pump control module 720C is part of automation module 720A (e.g., both pump control module 720C and automation module 720A represent functionality that is performed by the same software application or program).

In some embodiments, diagram 700 represents the logical architecture of an automated hydraulic fracturing system. In some embodiments, an automated hydraulic fracturing system includes one or more (e.g., some or all) of the components or modules illustrated in FIG. 7. For example, an automated hydraulic fracturing system can include automation module 720A. As another example, an automated hydraulic fracturing system can include modules 720A and 720C. In some embodiments, an automated hydraulic fracturing system includes additional components or modules not illustrated in FIG. 7. In some embodiments, some or all of the portions of diagram 700 are implemented by one or more software applications (or modules) implemented on one or more computer systems (e.g., such as device 1000).

Figure 8A:
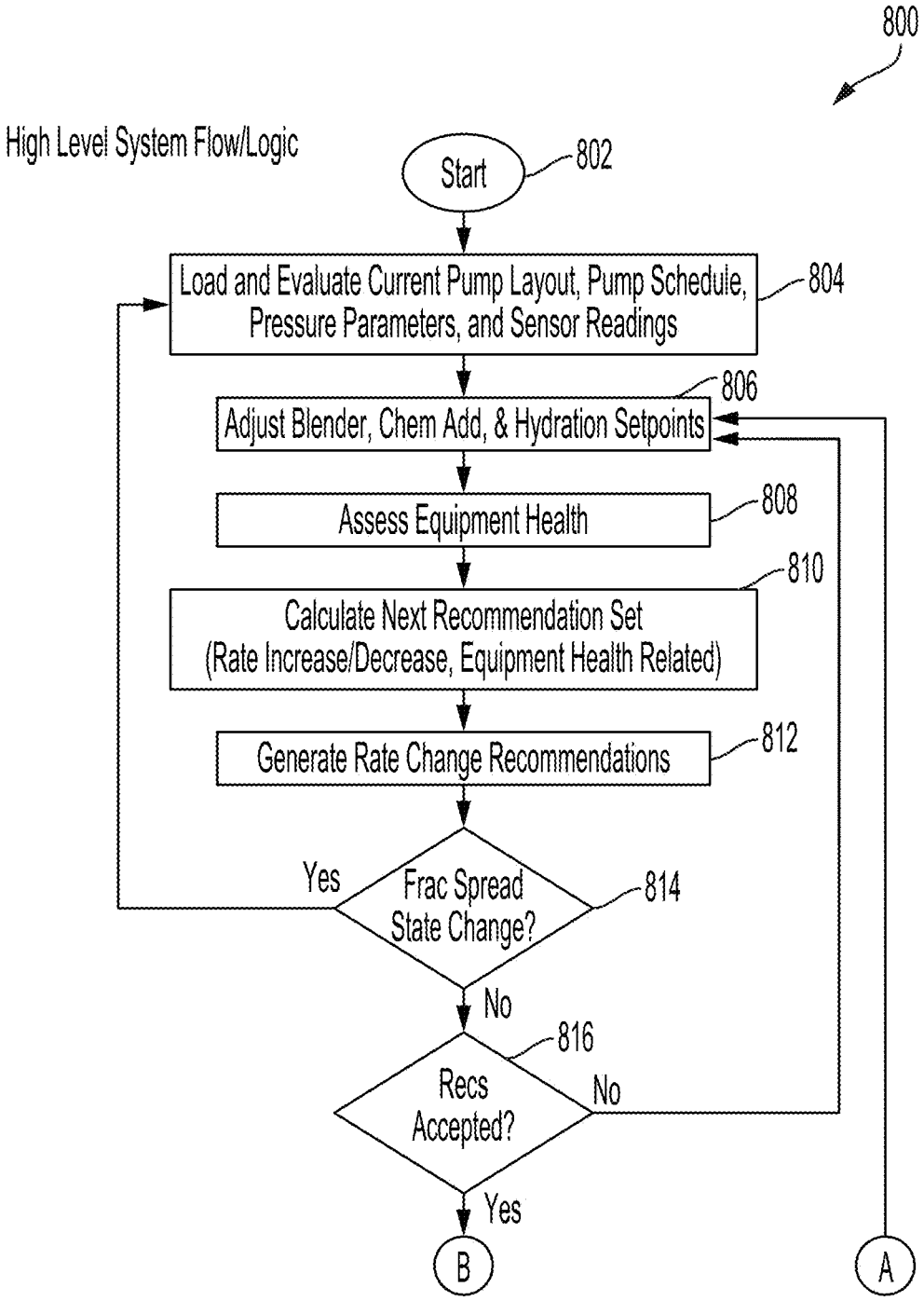
FIGS. 8A-8B illustrate a flow chart showing a process for control of a hydraulic fracturing operation in accordance with some embodiments.
Figure 8B:
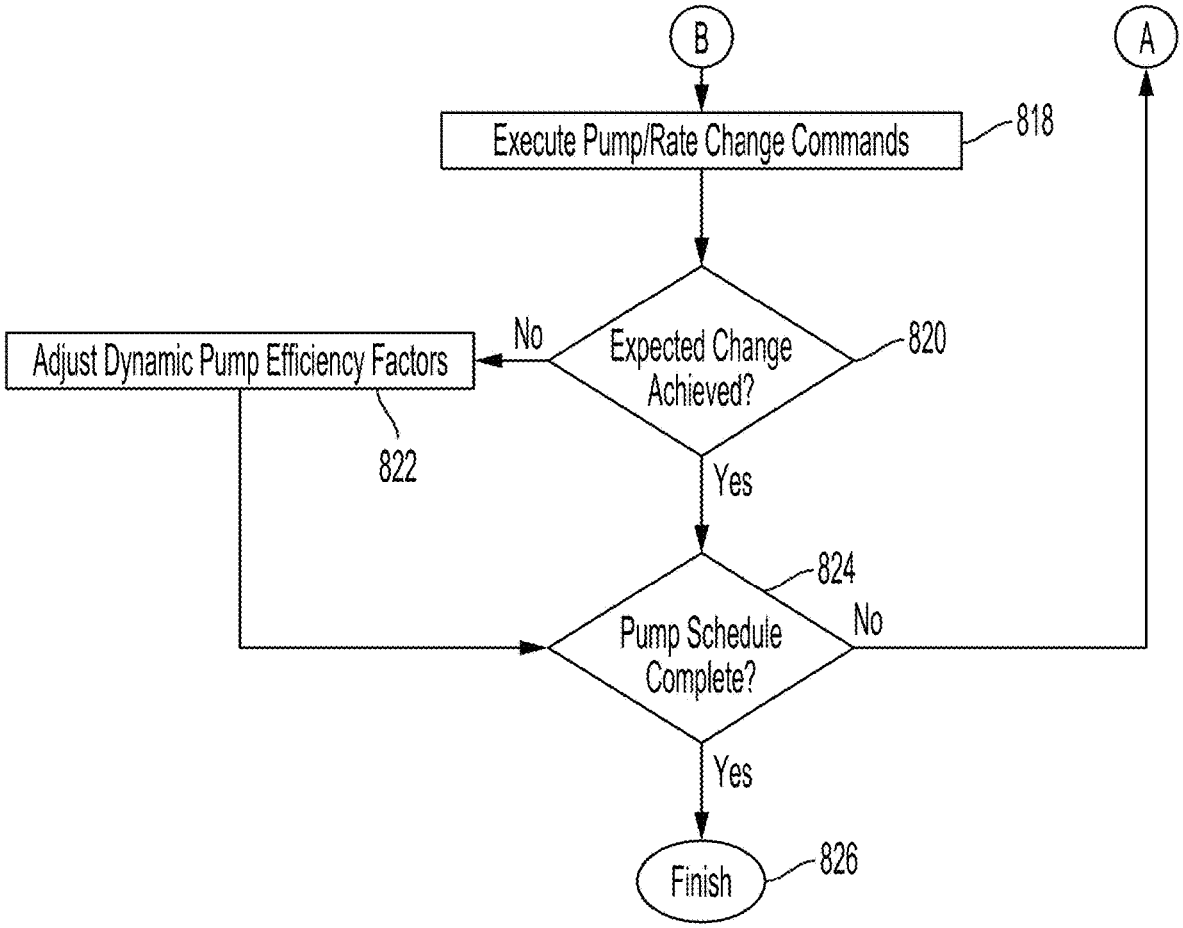

FIGS. 8A-8B illustrate a flow chart showing a process for control of a hydraulic fracturing operation in accordance with some embodiments. The steps of process 800 can be performed by one or more components of an automated hydraulic fracturing system, such as device 1000. At 802, process 800 begins. At 804, the automated hydraulic fracturing system loads and evaluates a current pump layout, pump schedule, pressure parameters, and sensor readings. At 806, the automated hydraulic fracturing system adjusts blender, chem add, and hydration setpoints. At 808, the automated hydraulic fracturing system assesses equipment health. At 810, the automated hydraulic fracturing system calculates a next recommendation set (e.g., rate increase/decrease, which can be related to (based on) equipment health). At 812, the automated hydraulic fracturing system generates one or more rate change recommendations. At 814, the automated hydraulic fracturing system determines whether there has been a frac spread state change (e.g., a change to operating conditions of the frac fleet). If the determination at 814 is yes, the automated hydraulic fracturing system returns to 804. If the determination at 814 is no, the automated hydraulic fracturing system proceeds to 816. At 816, the automated hydraulic fracturing system determines whether the rate change recommendations have been accepted. If the determination at 816 is no, the automated hydraulic fracturing system returns to 806. If the determination at 816 is yes, the automated hydraulic fracturing system proceeds to 818. At 818, the automated hydraulic fracturing system executes commands for implementing the accepted rate changes. At 820, the automated hydraulic fracturing system determines whether the expected change has been achieved. If the determination at 820 is no, the automated hydraulic fracturing system proceeds to 822. At 822, the automated hydraulic fracturing system adjusts dynamic pump efficiency factors. If the determination at 820 is yes, the automated hydraulic fracturing system proceeds to 824. At 824, the automated hydraulic fracturing system determines whether the pump schedule is complete. If the determination at 824 is no, the automated hydraulic fracturing system returns to 806. If the determination at 824 is yes, the automated hydraulic fracturing system proceeds to 826. At 826, process 800 ends.

Figure 9:
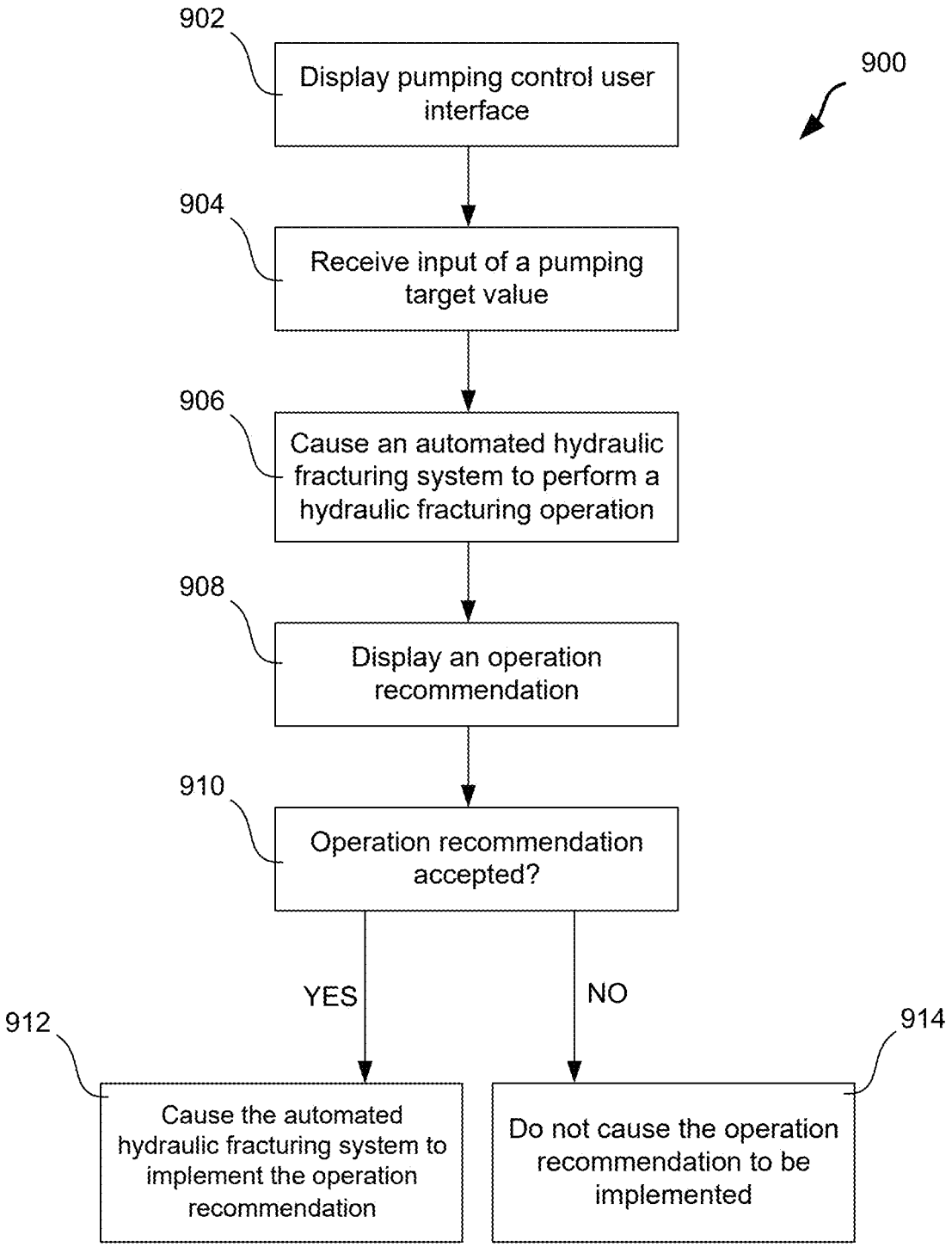
FIG. 9 illustrates a flow chart showing a process for control of a hydraulic fracturing operation in accordance with some embodiments.

FIG. 9 illustrates a flow chart showing a process for control of a hydraulic fracturing operation in accordance with some embodiments. The steps of process 900 can be performed by one or more components of an automated hydraulic fracturing system, such as device 1000. At 902, the automated hydraulic fracturing system displays pumping control user interface (e.g., 300 of FIG. 3). At 904, the automated hydraulic fracturing system receives input of a pumping target value (e.g., in input fields 402 and/or 404 of FIG. 4). At 906, the automated hydraulic fracturing system performs (e.g., caused by device 1000) a hydraulic fracturing operation (e.g., pumping according to the pumping value specified at 904). At 908, the automated hydraulic fracturing system displays an operation recommendation (e.g., 330 of FIG. 3 and/or 500 of FIG. 5). At 910, the automated hydraulic fracturing system determines whether the operation recommendation is accepted (e.g., whether control 510 of FIG. 5 has been selected). At 912, if the operation recommendation is accepted, the automated hydraulic fracturing system implements (e.g., caused by device 1000) the operation recommendation. At 914, if the operation recommendation is not accepted (e.g., declined), the automated hydraulic fracturing system does not implement the operation recommendation.

Figure 10:
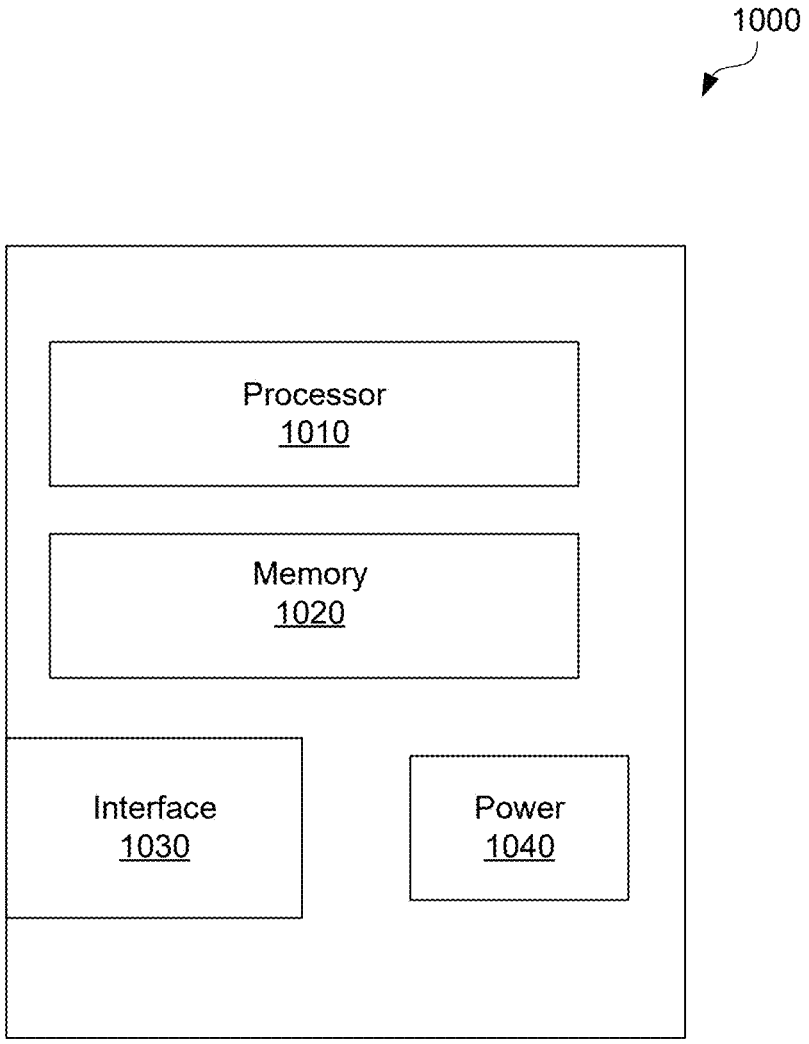
FIG. 10 illustrates a block diagram showing an example device in accordance with some embodiments.

FIG. 10 illustrates a block diagram showing an example device 1000. As shown in FIG. 10, the example device 1000 includes an interface 1030, a processor 1010, a memory 1020, and a power unit 1040. A device may include additional or different components, and the device 1000 may be configured to operate as described with respect to the examples above. In some implementations, the interface 1030, processor 1010, memory 1020, and power unit 1040 of a device are housed together in a common housing or other assembly. In some implementations, one or more of the components of a device can be housed separately, for example, in a separate housing or other assembly. Device 1000 can also be referred to as system 1000 or computer system 1000. In some embodiments, a hydraulic fracturing system (e.g., 10) includes one or more device (e.g., 1000).

The example interface 1030 can communicate (receive, transmit, or both) wireless signals. For example, the interface 1030 may be configured to communicate radio frequency (RF) signals formatted according to a wireless communication standard (e.g., Wi-Fi, 4G, 5G, Bluetooth, etc.). In some implementations, the example interface 1030 includes a radio subsystem and a baseband subsystem. The radio subsystem may include, for example, one or more antennas and radio frequency circuitry. The radio subsystem can be configured to communicate radio frequency wireless signals on the wireless communication channels. As an example, the radio subsystem may include a radio chip, an RF front end, and one or more antennas. The baseband subsystem may include, for example, digital electronics configured to process digital baseband data. In some cases, the baseband subsystem may include a digital signal processor (DSP) device or another type of processor device. In some cases, the baseband system includes digital processing logic to operate the radio subsystem, to communicate wireless network traffic through the radio subsystem or to perform other types of processes.

The example processor 1010 can execute instructions, for example, to generate output data based on data inputs. The instructions can include programs, codes, scripts, modules, or other types of data stored in memory 1020. Additionally, or alternatively, the instructions can be encoded as pre-programmed or re-programmable logic circuits, logic gates, or other types of hardware or firmware components or modules. The processor 1010 may be or include a general-purpose microprocessor, as a specialized co-processor or another type of data processing apparatus. In some cases, the processor 1010 performs high level operation of the device 1000. For example, the processor 1010 may be configured to execute or interpret software, scripts, programs, functions, executables, or other instructions stored in the memory 1020. In some implementations, the processor 1010 may be included in the interface 1030 or another component of the device 1000.

The example memory 1020 may include (e.g., non-transitory) computer-readable storage media, for example, a volatile memory device, a non-volatile memory device, or both. The memory 1020 may include one or more read-only memory devices, random-access memory devices, buffer memory devices, or a combination of these and other types of memory devices. In some instances, one or more components of the memory can be integrated or otherwise associated with another component of the device 1000. The memory 1020 may store instructions that are executable by the processor 1010. For example, the instructions may include instructions to perform one or more of the operations in the example processes described herein, for example, such as those described with respect to FIGS. 1-9.

The example power unit 1040 provides power to the other components of the device 1000. For example, the other components may operate based on electrical power provided by the power unit 1040 through a voltage bus or other connection. In some implementations, the power unit 1040 includes a battery or a battery system, for example, a rechargeable battery. In some implementations, the power unit 1040 includes an adapter (e.g., an AC adapter) that receives an external power signal (from an external source) and coverts the external power signal to an internal power signal conditioned for a component of the device 1000. The power unit 1040 may include other components or operate in another manner.

Some of the subject matter and operations described in this specification can be implemented in digital electronic circuitry, or in computer software, firmware, or hardware, including the structures disclosed in this specification and their structural equivalents, or in combinations of one or more of them. Some of the subject matter described in this specification can be implemented as one or more computer programs, i.e., one or more modules of computer program instructions, encoded on a computer storage medium for execution by, or to control the operation of, data-processing apparatus. A computer storage medium can be, or can be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially generated propagated signal. The computer storage medium can also be, or be included in, one or more separate physical components or media (e.g., multiple CDs, disks, or other storage devices).

Some of the operations described in this specification can be implemented as operations performed by a data processing apparatus on data stored on one or more computer-readable storage devices or received from other sources.

The term "data-processing apparatus" encompasses all kinds of apparatus, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them.

A computer program (also known as a program, software, software application, application, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program, or in multiple coordinated files (e.g., files that store one or more modules, sub programs, or portions of code). A computer program can be deployed to be executed on one computer or on multiple computers that are located at one site or distributed across multiple sites and interconnected by a communication network.

Some of the processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and processors of any kind of digital computer. Generally, a processor will receive instructions and data from a read-only memory or a random-access memory or both. Elements of a computer can include a processor that performs actions in accordance with instructions, and one or more memory devices that store the instructions and data. A computer may also include, or be operatively coupled to receive data from or transfer data to, or both, one or more mass storage devices for storing data, e.g., magnetic disks, magneto optical disks, or optical disks. However, a computer need not have such devices. Moreover, a computer can be embedded in another device, e.g., a phone, an electronic appliance, a mobile audio or video player, a game console, a Global Positioning System (GPS) receiver, or a portable storage device (e.g., a universal serial bus (USB) flash drive). Devices suitable for storing computer program instructions and data include all forms of non-volatile memory, media and memory devices, including by way of example semiconductor memory devices (e.g., EPROM, EEPROM, flash memory devices, and others), magnetic disks (e.g., internal hard disks, removable disks, and others), magneto optical disks, and CD ROM and DVD-ROM disks. In some cases, the processor and the memory can be supplemented by, or incorporated in, special purpose logic circuitry.

To provide for interaction with a user, operations can be implemented on a computer having a display device (e.g., a monitor, or another type of display device) for displaying information to the user and an input device for receiving input from a user. An input device can include a keyboard and/or a pointing device (e.g., a mouse, a trackball, a tablet, a touch sensitive screen, or another type of pointing device) by which the user can provide input to the computer. Other kinds of input or output devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

A computer system may include a single computing device, or multiple computers that operate in proximity or generally remote from each other and typically interact through a communication network. Examples of communication networks include a local area network ("LAN") and a wide area network ("WAN"), an inter-network (e.g., the Internet), a network comprising a satellite link, and peer-to-peer networks (e.g., ad hoc peer-to-peer networks). A relationship of client and server may arise by virtue of computer programs running on the respective computers and having a client-server relationship to each other.

In a general aspect, a pumping control user interface is used to control an automated hydraulic fracturing system.

In a first example, a method is performed at a system (e.g., 1000) that includes one or more processors, memory, an input device, and a display (e.g., a display device). The method includes displaying, on the display, a pumping control interface (e.g., 300) associated with a plurality of fracturing pumps (e.g., 14), the pumping control interface comprising: a target input region (e.g., 340 and/or 400) representing one or more pumping target values (e.g., 402 and/or 404) of a hydraulic fracturing operation. The method includes receiving, at the input device, first input (e.g., at 402 and/or 404 for the target input region, wherein the first input indicates a value for at least one of the one or more pumping target values of the hydraulic fracturing operation. The method includes after receiving the first input, causing, by operation of the one or more processors, a hydraulic fracturing system (e.g., 10) to perform the hydraulic fracturing operation according to the one or more pumping target values including the value indicated by the first input, wherein causing the hydraulic fracturing system to perform the hydraulic fracturing operation includes: causing at least one of the plurality of fracturing pumps to operate based on the one or more pumping target values. The method includes, while the hydraulic fracturing operation is being performed, displaying, on the display, an operation recommendation (e.g., 508) in the pumping control interface, wherein displaying the operation recommendation includes displaying a suggested change (e.g., 508A, 508B, and/or 508C) to an operating setting associated with at least one of the plurality of fracturing pumps. The method includes receiving, at the input device, second input (e.g., selection of 510) corresponding to acceptance of the operation recommendation. The method includes in response to receiving the second input, causing the hydraulic fracturing system to implement the operation recommendation and continue performing the hydraulic fracturing operation.

Implementations of the first example may include one or more of the following features. The suggested change to an operating setting indicates a change to a target pumping rate (e.g., of 404) for the hydraulic fracturing operation. The value indicated by the first input is a first value for the target pumping rate; and the change to the target pumping rate represents changing to a second value for the target pumping rate different from the first value (e.g., reduction or increase to the value in 404). The suggested change to an operating setting indicates a change to an actual pumping rate for the hydraulic fracturing operation. Displaying the operation recommendation includes displaying one or more current operating settings (e.g., as in 508B and/or 508C) associated with at least one of the plurality of fracturing pumps. The target input region is displayed concurrently with the operation recommendation (e.g., 330 and 340 displayed concurrently as in FIG. 3). The operating setting includes one or more of: a selected gear for a transmission coupled to a motor; a throttle setting for a motor (e.g., in percent); a motor speed setting (e.g., in RPMs); and an operational state of a motor (e.g., health problem, on or off, enabled or disabled, and/or energized or de-energized). The plurality of fracturing pumps are powered by one or more of: one or more electric motors; one or more dual fuel motors; and one or more diesel motors. The pumping control interface comprises a pump information region (e.g., 320) that includes, for each fracturing pump of the plurality of fracturing pumps, one or more of: a selected gear for a transmission coupled to a motor that powers the respective fracturing pump; a throttle setting for the motor that powers the respective fracturing pump; a motor speed setting for the motor that powers the respective fracturing pump; an operational state of the motor that powers the respective fracturing pump (e.g., health problem, on or off, enabled or disabled, and/or energized or de-energized); a maximum motor speed for the motor that powers the respective fracturing pump (e.g., in 320E); a current pressure reading for the respective fracturing pump (e.g., in 320E); a maximum pressure rating for the respective fracturing pump (e.g., in 320E); and an indication of availability of the respective fracturing pump (e.g., in 320F). The pumping control interface comprises pump grouping information (e.g., in 320A) that indicates groupings of fracturing pumps of the plurality of fracturing pumps. The target input region includes an input field (e.g., 404) for receiving a value of a target pumping rate for the hydraulic fracturing operation. The target input region includes an input field (e.g., 402) for receiving a value of a target pumping pressure for the hydraulic fracturing operation. The target input region includes one or more input fields (e.g., 406A, 408A, 408B, 410A, and/or 410B) for receiving values associated with one or more ramp up periods of the hydraulic fracturing operation. The target input region includes one or more input fields (e.g., 412) for receiving values of a target pumping rate reduction step size for one or more ramp down periods of the hydraulic fracturing operation. While the hydraulic fracturing operation is being performed, displaying, on the display, a second operation recommendation (e.g., 508) in the pumping control interface, wherein displaying the second operation recommendation includes displaying a second suggested change (e.g., 508A, 508B, and/or 508C) to an operating setting associated with at least one of the plurality of fracturing pumps; receiving, at the input device, third input corresponding to rejection (e.g., selection of 512) of the second operation recommendation; and in response to receiving the second input, causing the hydraulic fracturing system to continue performing the hydraulic fracturing operation without implementing the second operation recommendation.

In a second example, a system (e.g., device 1000) includes an input device, a display, one or more processors, and a computer-readable medium storing instructions that are operable when executed by the one or more processors to perform one or more operations of the first example.

In a third example, a non-transitory computer-readable medium storing instructions that are operable when executed by a data processing apparatus (e.g., device 1000) to perform one or more operations of the first example.

While this specification contains many details, these should not be understood as limitations on the scope of what may be claimed, but rather as descriptions of features specific to particular examples. Certain features that are described in this specification or shown in the drawings in the context of separate implementations can also be combined. Conversely, various features that are described or shown in the context of a single implementation can also be implemented in multiple embodiments separately or in any suitable subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single product or packaged into multiple products.

A number of embodiments have been described. Nevertheless, it will be understood that various modifications can be made. Accordingly, other embodiments are within the scope of the following claims.

What is claimed is:

1. A method, comprising:

at a system that includes one or more processors, memory, an input device, and a display:

displaying, on the display, a pumping control interface associated with a plurality of fracturing pumps, the pumping control interface comprising:

a target input region representing one or more pumping target values of a hydraulic fracturing operation;

receiving, at the input device, first input for the target input region, wherein the first input indicates a value for at least one of the one or more pumping target values of the hydraulic fracturing operation;

after receiving the first input, causing, by operation of the one or more processors, a hydraulic fracturing system to perform the hydraulic fracturing operation according to the one or more pumping target values including the value indicated by the first input, wherein causing the hydraulic fracturing system to perform the hydraulic fracturing operation includes:

causing at least one of the plurality of fracturing pumps to operate based on the one or more pumping target values;

while the hydraulic fracturing operation is being performed, displaying, on the display, an operation recommendation in the pumping control interface, wherein displaying the operation recommendation includes displaying a suggested change to an operating setting associated with at least one of the plurality of fracturing pumps;

receiving, at the input device, second input corresponding to acceptance of the operation recommendation; and in response to receiving the second input, causing the hydraulic fracturing system to implement the operation recommendation and continue performing the hydraulic fracturing operation.

2. The method of claim 1, wherein the suggested change to an operating setting indicates a change to a target pumping rate for the hydraulic fracturing operation.

3. The method of claim 2, wherein:

the value indicated by the first input is a first value for the target pumping rate; and the change to the target pumping rate represents changing to a second value for the target pumping rate different from the first value.

4. The method of claim 1, wherein the suggested change to an operating setting indicates a change to an actual pumping rate for the hydraulic fracturing operation.

5. The method of claim 1, wherein displaying the operation recommendation includes displaying one or more current operating settings associated with at least one of the plurality of fracturing pumps.

6. The method of claim 1, wherein the target input region is displayed concurrently with the operation recommendation.

7. The method of claim 1, wherein the operating setting includes one or more of:

a selected gear for a transmission coupled to a motor;

a throttle setting for a motor;

a motor speed setting; and an operational state of a motor.

8. The method of claim 1, wherein the plurality of fracturing pumps are powered by one or more of:

one or more electric motors;

one or more dual fuel motors; and one or more diesel motors.

9. The method of claim 1, wherein the pumping control interface comprises a pump information region that includes, for each fracturing pump of the plurality of fracturing pumps, one or more of:

a selected gear for a transmission coupled to a motor that powers the respective fracturing pump;

a throttle setting for the motor that powers the respective fracturing pump;

a motor speed setting for the motor that powers the respective fracturing pump;

an operational state of the motor that powers the respective fracturing pump;

a maximum motor speed for the motor that powers the respective fracturing pump;

a current pressure reading for the respective fracturing pump;

a maximum pressure rating for the respective fracturing pump; and an indication of availability of the respective fracturing pump.

10. The method of claim 1, wherein the pumping control interface comprises pump grouping information that indicates groupings of fracturing pumps of the plurality of fracturing pumps.

11. The method of claim 1, wherein the target input region includes an input field for receiving a value of a target pumping rate for the hydraulic fracturing operation.

12. The method of claim 1, wherein the target input region includes an input field for receiving a value of a target pumping pressure for the hydraulic fracturing operation.

13. The method of claim 1, wherein the target input region includes one or more input fields for receiving values associated with one or more ramp up periods of the hydraulic fracturing operation.

14. The method of claim 1, wherein the target input region includes one or more input fields for receiving values of a target pumping rate reduction step size for one or more ramp down periods of the hydraulic fracturing operation.

15. The method of claim 1, further comprising:

while the hydraulic fracturing operation is being performed, displaying, on the display, a second operation recommendation in the pumping control interface, wherein displaying the second operation recommendation includes displaying a second suggested change to an operating setting associated with at least one of the plurality of fracturing pumps;

receiving, at the input device, third input corresponding to rejection of the second operation recommendation; and in response to receiving the second input, causing the hydraulic fracturing system to continue performing the hydraulic fracturing operation without implementing the second operation recommendation.

16. A system comprising:

an input device;

a display;

one or more processors; and a computer-readable medium storing instructions that are operable when executed by the one or more processors to perform operations comprising:

displaying, on the display, a pumping control interface associated with a plurality of fracturing pumps, the pumping control interface comprising:

a target input region representing one or more pumping target values of a hydraulic fracturing operation;

receiving, at the input device, first input for the target input region, wherein the first input indicates a value for at least one of the one or more pumping target values of the hydraulic fracturing operation;

after receiving the first input, causing, by operation of the one or more processors, a hydraulic fracturing system to perform the hydraulic fracturing operation according to the one or more pumping target values including the value indicated by the first input, wherein causing the hydraulic fracturing system to perform the hydraulic fracturing operation includes:

causing at least one of the plurality of fracturing pumps to operate based on the one or more pumping target values;

while the hydraulic fracturing operation is being performed, displaying, on the display, an operation recommendation in the pumping control interface, wherein displaying the operation recommendation includes displaying a suggested change to an operating setting associated with at least one of the plurality of fracturing pumps;

receiving, at the input device, second input corresponding to acceptance of the operation recommendation; and in response to receiving the second input, causing the hydraulic fracturing system to implement the operation recommendation and continue performing the hydraulic fracturing operation.

17. The system of claim 16, wherein the suggested change to an operating setting indicates a change to a target pumping rate for the hydraulic fracturing operation.

18. The system of claim 16, wherein the suggested change to an operating setting indicates a change to an actual pumping rate for the hydraulic fracturing operation.

19. The system of claim 16, wherein displaying the operation recommendation includes displaying one or more current operating settings associated with at least one of the plurality of fracturing pumps.

20. The system of claim 16, wherein the target input region is displayed concurrently with the operation recommendation.

21. The system of claim 16, wherein the operating setting includes one or more of:

a selected gear for a transmission coupled to a motor;

a throttle setting for a motor;

a motor speed setting; and an operational state of a motor.

22. A non-transitory computer-readable medium storing instructions that are operable when executed by a data-processing apparatus to perform operations comprising:

displaying, on a display, a pumping control interface associated with a plurality of fracturing pumps, the pumping control interface comprising:

a target input region representing one or more pumping target values of a hydraulic fracturing operation;

receiving, at an input device, first input for the target input region, wherein the first input indicates a value for at least one of the one or more pumping target values of the hydraulic fracturing operation;

after receiving the first input, causing, by operation of the one or more processors, a hydraulic fracturing system to perform the hydraulic fracturing operation according to the one or more pumping target values including the value indicated by the first input, wherein causing the hydraulic fracturing system to perform the hydraulic fracturing operation includes:

causing at least one of the plurality of fracturing pumps to operate based on the one or more pumping target values;

while the hydraulic fracturing operation is being performed, displaying, on the display, an operation recommendation in the pumping control interface, wherein displaying the operation recommendation includes displaying a suggested change to an operating setting associated with at least one of the plurality of fracturing pumps;

receiving, at the input device, second input corresponding to acceptance of the operation recommendation; and in response to receiving the second input, causing the hydraulic fracturing system to implement the operation recommendation and continue performing the hydraulic fracturing operation.

23. The non-transitory computer-readable medium of claim 22, wherein the suggested change to an operating setting indicates a change to a target pumping rate for the hydraulic fracturing operation.

24. The non-transitory computer-readable medium of claim 22, wherein the suggested change to an operating setting indicates a change to an actual pumping rate for the hydraulic fracturing operation.

25. The non-transitory computer-readable medium of claim 22, wherein displaying the operation recommendation includes displaying one or more current operating settings associated with at least one of the plurality of fracturing pumps.

26. The non-transitory computer-readable medium of claim 22, wherein the target input region is displayed concurrently with the operation recommendation.

27. The non-transitory computer-readable medium of claim 22, wherein the operating setting includes one or more of:

a selected gear for a transmission coupled to a motor;

a throttle setting for a motor;

a motor speed setting; and an operational state of a motor.

* * * * *